US010065662B2

(12) United States Patent
Rodet

(10) Patent No.: US 10,065,662 B2
(45) Date of Patent: Sep. 4, 2018

(54) MOTORIZED BOGIE FOR A LOW FLOOR RAILWAY VEHICLE

(71) Applicant: ALSTOM TRANSPORT TECHNOLOGIES, Saint-Ouen (FR)

(72) Inventor: Alain Rodet, Chalon sur Saône (FR)

(73) Assignee: Alstom Transport Technologies, Saint-Ouen (FR)

( * ) Notice: Subject to any disclaimer, the term of this patent is extended or adjusted under 35 U.S.C. 154(b) by 251 days.

(21) Appl. No.: 14/969,412

(22) Filed: Dec. 15, 2015

(65) Prior Publication Data

US 2016/0167681 A1 Jun. 16, 2016

(30) Foreign Application Priority Data

Dec. 15, 2014 (FR) ..... 14 62449

(51) Int. Cl.

| | |
|---|---|
| ***B61F 5/08*** | (2006.01) |
| ***B61F 3/00*** | (2006.01) |
| ***B61F 5/52*** | (2006.01) |
| ***B61C 9/50*** | (2006.01) |
| ***B61F 3/04*** | (2006.01) |

(52) U.S. Cl.

CPC ..... *B61F 5/08* (2013.01); *B61C 9/50* (2013.01); *B61F 3/00* (2013.01); *B61F 3/04* (2013.01); *B61F 5/52* (2013.01)

(58) Field of Classification Search

CPC ..... B61F 3/00; B61F 3/02; B61F 3/04; B61F 3/12; B61F 5/00; B61F 5/04; B61F 5/06; B61F 5/08; B61F 5/26; B61F 5/50; B61F 5/52

See application file for complete search history.

(56) References Cited

U.S. PATENT DOCUMENTS

2013/0019774 A1* 1/2013 Ahuja ..... B61G 9/50 105/133

FOREIGN PATENT DOCUMENTS

| | | | |
|---|---|---|---|
| CN | 103832440 | A | 6/2014 |
| DE | 4139228 | C1 | 12/1992 |
| FR | 2826328 | A1 | 12/2002 |
| RU | 2294292 | C1 | 2/2007 |

OTHER PUBLICATIONS

Search Report dated Aug. 6, 2015 in FR application No. 1462449.

* cited by examiner

*Primary Examiner* — Robert J McCarry, Jr.

(74) *Attorney, Agent, or Firm* — Knobbe, Martens, Olson & Bear, LLP

(57) ABSTRACT

A bogie includes a chassis, including two beams, two crosspieces, two axle structures, each including two journal boxes, and a transverse axle shaft, extending in the transverse direction between two ends each supporting a respective wheel, the wheels defining an inner space between them, defined in the transverse direction between the wheels of a same axle shaft, and defined in the longitudinal direction between the two axle shafts, at least one motor supported by one of the crosspieces of the chassis, arranged in the inner space defined by the wheels, and including a coupling shaft, and at least one reducer. The bogie includes a primary suspension, including flexible mountings arranged between the crosspieces and the beams of the chassis, the reducer is arranged outside the inner space, the coupling shaft of the motor extending from the motor beyond one of the corresponding beams to the reducer.

10 Claims, 5 Drawing Sheets

MOTORIZED BOGIE FOR A LOW FLOOR RAILWAY VEHICLE

CROSS-REFERENCE TO RELATED APPLICATIONS

This application claims priority to French Patent Application No. FR 14 62449 filed on Dec. 15, 2014, the disclosure of which including the specification, the drawings, and the claims is hereby incorporated by reference in its entirety.

TECHNICAL FIELD OF THE INVENTION

The present invention relates to a motorized bogie for a low floor railway vehicle.

BACKGROUND OF THE INVENTION

A motorized bogie is in particular designed to equip a railway vehicle whereof the body is arranged in two floors for transporting passengers. Typically, the two floors extend along a central portion A of the body that is situated between two bogies (as shown in FIG. 6).

Access doors to the vehicle, allowing passengers easy access to the vehicle from the platform or to the platform from the vehicle, are also situated between the two bogies. Indeed, due to the height of a traditional bogie, it is not possible to arrange an access door at such a bogie, since the height of the door would then be incompatible with the height of the platform. Traditionally, the doors are therefore arranged adjacent to the bogies of the railway vehicle.

Such an arrangement of the doors is not fully satisfactory. Indeed, the central part of the body, in which the two floors are arranged, is thus limited by the bogies and the doors. Typically, a compartment with a single floor is arranged in register with the bogies, but such a compartment can only receive a small number of passengers.

SUMMARY OF THE INVENTION

The invention in particular aims to resolve this drawback, by proposing a motorized bogie making it possible to increase the number of passengers who can be transported in a railway vehicle.

To that end, the invention relates to a motorized bogie for a railway vehicle, comprising:

- a chassis, including:
  - two beams extending parallel to one another, and parallel to the longitudinal direction,
  - two crosspieces, supported by the beams, extending parallel to one another, and parallel to a transverse direction perpendicular to the longitudinal direction,
  - two supports, each support being supported by the two crosspieces,
- two axle structures, each comprising two journal boxes each connected to a respective one of the beams, and a transverse axle shaft, extending in the transverse direction between two ends each supporting a respective wheel, the wheels defining an inner space between them, delimited in the transverse direction between the wheels of a same axle shaft, and delimited in the longitudinal direction between the two axle shafts,
- at least one motor supported by one of the crosspieces of the chassis, arranged in the inner space delimited by the wheels, and including a coupling shaft,

- at least one reducer ensuring the mechanical connection between the coupling shaft of the motor and one of the transverse axle shafts, characterized in that:

- the bogie includes primary suspension means, including first suspension elements arranged between the crosspieces and the beams of the chassis,
- the reducer is arranged outside said inner space, the coupling shaft of the motor extending from the motor beyond one of the corresponding beams to the reducer.

In a bogie of the state of the art, the primary suspension means are arranged outside the inner space, and the reducer is arranged in that inner space. Such a reducer is particularly cumbersome, in particular in terms of height, such that it is the height of this reducer that sets the lower limit of the distance between a bearing plane of the wheels and a railway vehicle body supported by the bogie.

According to the invention, the structure of the primary suspension means, the first suspension elements of which are arranged in the inner space, makes it possible to free the space outside the inner space.

It is then possible to arrange the reducer outside the inner space, such that this reducer is no longer arranged in register with the body of the railway vehicle. Thus, in the invention, the reducer does not influence the minimum distance between the bearing plate of the wheels and the body of the railway vehicle.

In a bogie according to the invention, this minimum distance is imposed by the apex of the journal boxes, which have a height smaller than that of the reducer. Thus, in the invention, the minimum distance between the bearing plane of the wheels and the body of the railway vehicle is smaller than that imposed by the structure of a bogie of the state of the art.

The body being lowered, it is possible to arrange a door of that body at the bogie, that door being able to be arranged at the platform. This makes it possible to increase the length of the central part of the body where the two floors are arranged. The length of the two floors being increased, the capacity for receiving passengers in the body is thus increased.

The motorized bogie according to the invention may include one or more of the following features, considered alone or according to any technically possible combination(s):

- each axle structure is connected with a respective one of the beams by an articulation with an axis parallel to the transverse direction, and
- the primary suspension means include, for each axle structure, at least one second suspension element arranged between the axle structure and the beam;
- secondary suspension means, supported by each support of the chassis, and including bearing means at the railway vehicle body, the secondary suspension means being arranged transversely at least partially outside the inner space;
- each first suspension element is ring-shaped and is made from an elastic material, this first suspension element being inserted radially between one of the crosspieces of the chassis and the edges of an orifice arranged in one of the beams;
- each first suspension element is made from rubber;
- each first suspension element has an annular shape defined between an inner diameter and an outer diameter, the difference between this inner diameter and this outer diameter being substantially equal to 100 mm;

each second suspension element is formed by a connecting rod.

The invention also relates to a railway vehicle including a body, characterized in that it includes a bogie as previously defined.

Advantageously, the railway vehicle includes one or more of the following features, considered alone or according to any technically possible combination:

the body includes at least one access door arranged at the bogie;

the distance, in a vertical direction perpendicular to the longitudinal and transverse directions, between the access door and the bearing plane of the wheels, is less than or equal to 850 mm.

BRIEF DESCRIPTION OF THE DRAWINGS

The invention will be better understood upon reading the following description, provided solely as an example, and in reference to the appended drawings, in which.

DETAILED DESCRIPTION OF SOME EMBODIMENTS

In the present description, the terms "vertical" and "horizontal" are defined within their usual meanings, relative to a bogie mounted in a railway vehicle. Thus, a horizontal plane is substantially parallel to a plane in which bogie axles extend, and a vertical plane is substantially parallel to a plane in which bogie wheels extend.

The term "longitudinal" is defined according to its usual meaning, as applying to the direction in which a railway vehicle extends in a horizontal plane, and the term "transverse" is defined according to its usual meaning, as applying to a direction substantially perpendicular to the longitudinal direction in a horizontal plane.

These figures show a plane of reference, in which a longitudinal direction is designated by reference X, a transverse direction is designated by reference Y, and a vertical direction, perpendicular to the longitudinal X and transverse Y directions, is designated by reference Z.

Furthermore, the terms "front" and "rear" are defined according to their usual meanings relative to the movement direction of the railway vehicle in the longitudinal direction X. By convention, in the figures, the term "front" corresponds to the left and the term "rear" corresponds to the right. It should be noted that a railway vehicle may typically travel in two opposite directions, the terms "front" and "rear" then being reversed equivalently when the travel direction is reversed.

Figure 1:
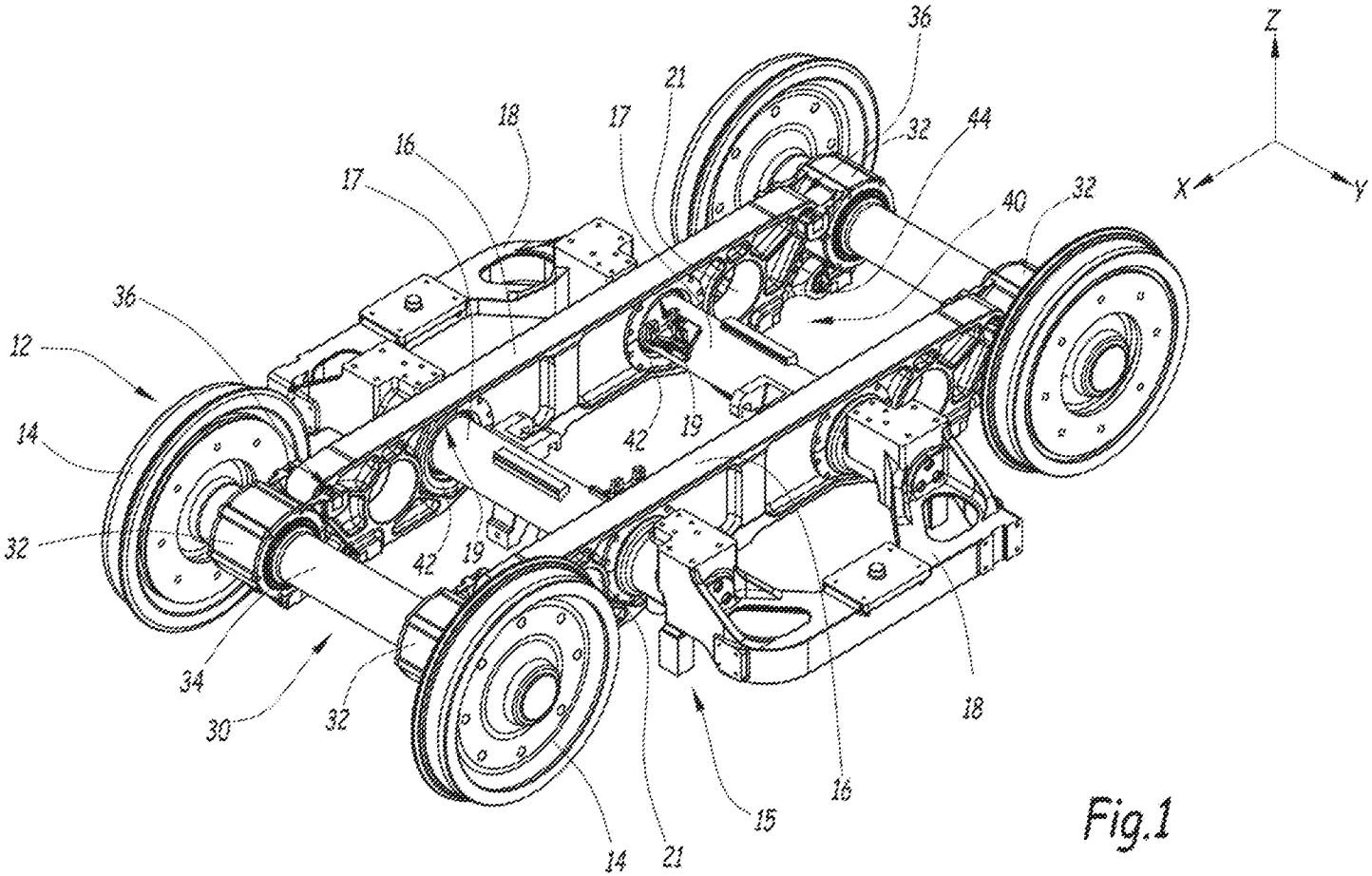
FIG. 1 is a perspective view of a skeleton of a railway vehicle bogie according to one example embodiment of the invention.
Figure 2:
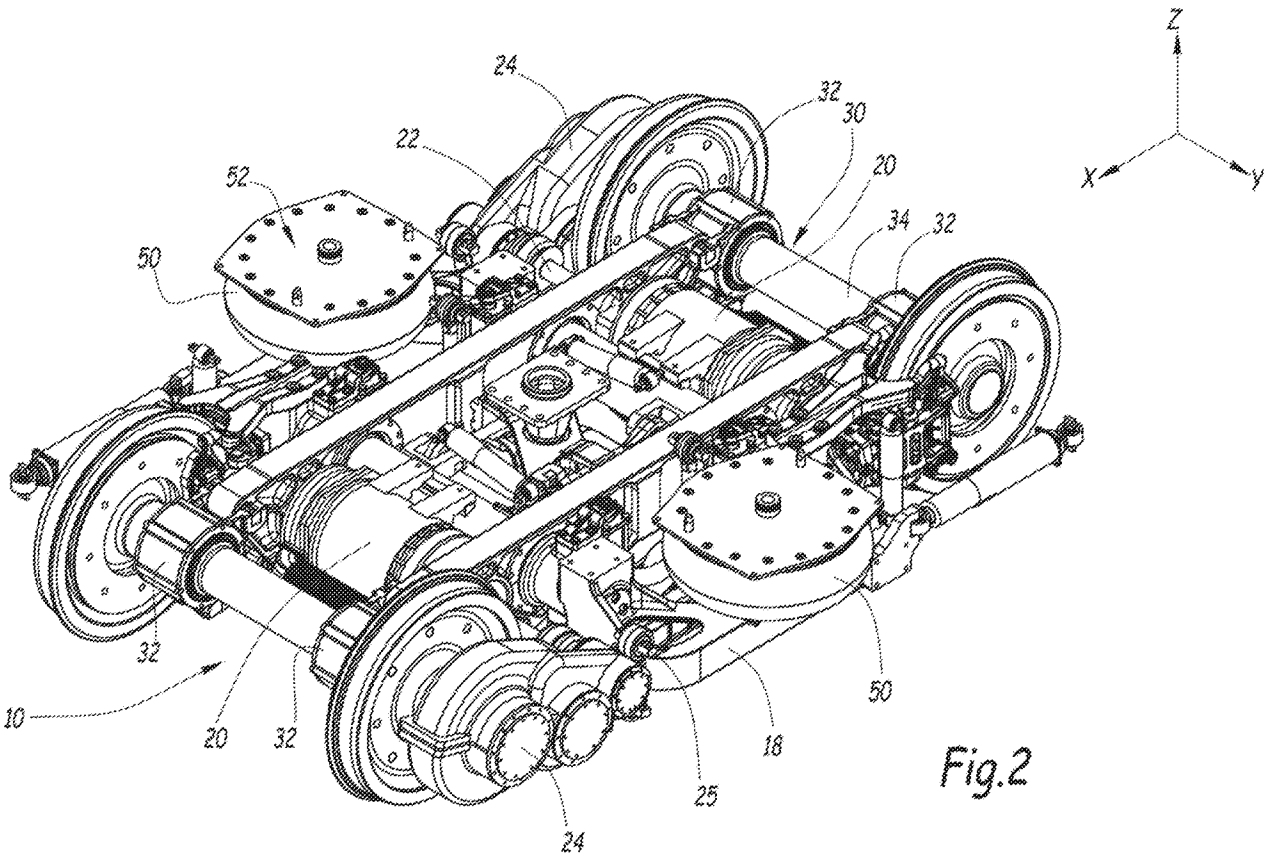
FIG. 2 is a perspective view of a railway vehicle bogie, including the framework of FIG. 1.

FIG. 2 shows a railway vehicle bogie 10, for example for a low floor regional express transportation train (TER). FIG. 1 also shows a skeleton of this bogie 10.

The bogie 10 comprises two pairs 12 of wheels 14, respectively arranged at the front and rear of the bogie 10. The wheels 14 of each pair 12 are supported and connected to one another by an axle structure 30 respectively belonging to that pair 12.

Each axle structure 30 includes two journal boxes 32, i.e., one for each wheel 14, as well as an axle shaft 34 extending in the transverse direction Y between two ends, each of which supports a respective wheel 14.

In the present description, an inner space I is defined, delimited in the transverse direction between the wheels 14, and in the longitudinal direction between the axle shafts 34.

The axle structures 30 bear a chassis 15 by means of articulations 36 and primary suspension means 40, which will be described later.

The chassis 15 includes two lateral beams 16, of the balance type, each extending parallel to the longitudinal direction X, two crosspieces 17, each extending parallel to the transverse direction Y, therefore transverse to the lateral beams 16, and two supports 18, of the bracket type, designed to receive the body 60 of the railway vehicle.

Each beam 16 is connected, at one of its ends, to a respective journal box 32, using a respective articulation 36.

Each articulation 36 for example includes a rod with axes parallel to the transverse direction Y, supported at the end of the corresponding beams 16, cooperating with a complementary pivot element supported by the journal box 32. This pivot element is supported below an apex of the journal box 32, in the vertical direction Z, such that the beam 16 extends below this apex of the journal box 32.

More particularly, this apex of the journal box 32 imposes a minimum limit on a height at which a body 60 of the railway vehicle can be arranged, supported by the bogie 10. In other words, the minimum value of a distance D, shown in FIG. 5, between the bearing plate of the wheels 14 and bearing means 52 at the body 60 of the railway vehicle is imposed by the height of this journal box apex 32.

Figure 4:
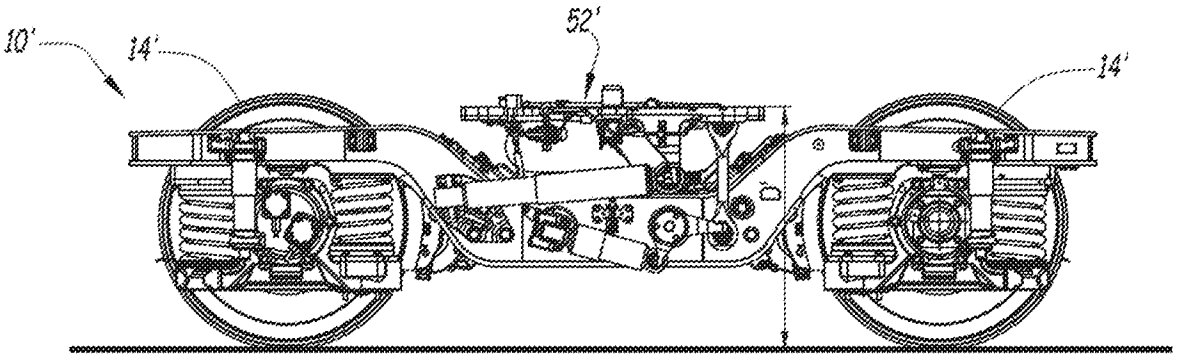
Fig.4 Prior Art
FIG. 4 is a side view of a bogie of the state of the art.

It will be noted that, in the state of the art, as shown in FIG. 4, the minimum value of a distance D' between a bearing plate of the wheels 14' and bearing means 52' at a body 60' of a railway vehicle is imposed by the height of an apex of a reducer. Thus, this distance D' in a bogie 10' of the state of the art is greater than the distance D of the bogie according to the invention.

The primary suspension means 40 include first suspension elements 42, such as a bushing or a flexible mounting, arranged between the crosspieces 17 and the beams 16, providing the connection between these crosspieces 17 and these beams 16.

More particularly, first transverse openings 19 are arranged in the beams 16 to receive the crosspieces 17. Advantageously, the first transverse openings 19 have a cross-section with a shape generally identical to that of the cross-section of the crosspieces 17, for example a circular section. Each crosspiece 17 crosses through a respective one of the transverse openings 19 of each beam, such that each crosspiece 17 extends laterally beyond the beams 16. The two crosspieces 17 together support, at each of their ends, a respective one of the supports 18 designed to receive the body 60 of the railway vehicle.

In the described example, each crosspiece 17 has a diameter smaller than a diameter of the openings 19, such that a free annular space is defined between the crosspieces 17 and the beams 16.

As previously indicated, the first suspension elements 42 are advantageously arranged in the free annular spaces between the beams 16 and the crosspieces 17.

As shown in FIG. 1, which shows one preferred embodiment, the first suspension elements 42 each have a generally annular shape, and each form an elastic connection between one of the beams 16 and a respective one of the crosspieces 17.

The annular suspension element 42 has an outer diameter defined between a plane X-Z including the longitudinal X and vertical Z directions and an inner diameter defined in the plane X-Z.

A difference between this outer diameter and a this inner diameter is preferably 100 mm, which substantially corresponds to the difference between the diameter of the crosspieces 17 and the diameter of the corresponding opening 19. Furthermore, the suspension element 42 includes a dimension in the transverse direction Y comprised between 100 and 150 mm. These first suspension elements 42 are made from an elastic material, for example rubber.

It will be noted that the first suspension elements 42 are less off-centered than the traditional primary suspension means. More particularly, considering the center of the bogie C, shown in FIG. 3, defined as a point longitudinally midway between the axles 30, and transversely midway between the planes of the wheels 14, the distance between the first suspension elements 42 and the center C is smaller than the distance between the traditional primary suspension means and a center C of the state of the art. Thus, when the bogie passes over track defects (also called "distortions"), the vertical movement of the first suspension elements 42 is smaller than the vertical movement of traditional primary suspension means. Since the vertical movement experienced by the first suspension elements 42 is produced, the dimensions of these first suspension elements 42 in the vertical direction Z is reduced relative to those of the traditional primary suspension means.

The primary suspension means 40 also include second suspension elements 44, such as a damper, arranged between the beams 16 and the journal boxes 32. More particularly, as is in particular shown in FIG. 1, each second suspension element 44 is arranged between an end of a respective one of the beams 16 and one of the journal boxes 32, the second suspension element 44 being designed to damp a relative rotational movement of the beams 16 and of the corresponding journal box 32 around the articulation 36.

Each second suspension element 44 for example includes an arm extending substantially in the longitudinal direction X from the end of the corresponding beams 16, up to the corresponding journal box 32, to which it is connected by a pivot link. Each second suspension element 44 is for example arranged, relative to the vertical direction Z, below the articulation 36 supported by the same end of the beams 16.

Each second suspension element 44 is for example formed by a connecting rod.

Figure 3:
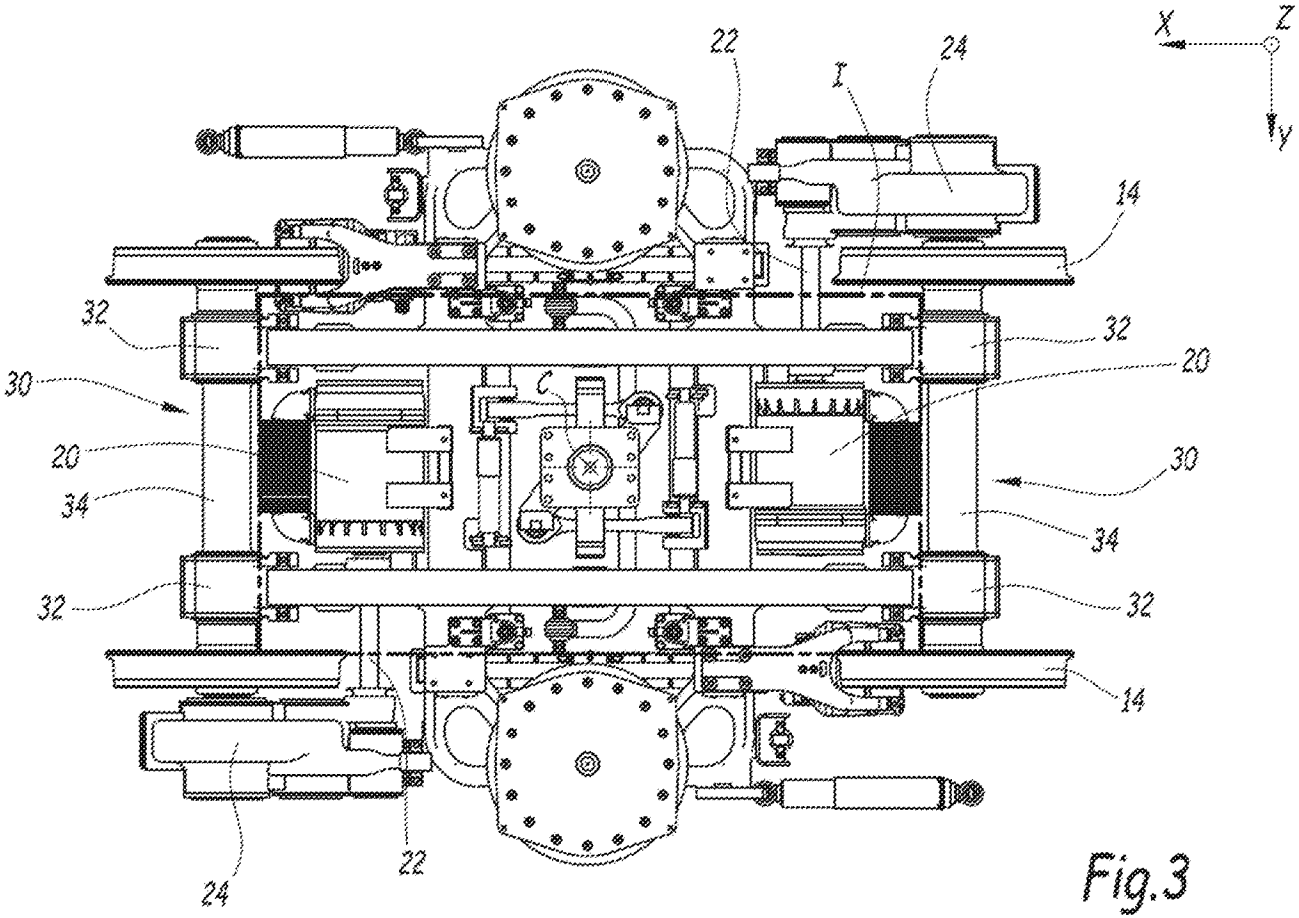
FIG. 3 is a view of the top of the bogie of FIG. 2.

FIG. 3 shows two motors 20 that are each respectively supported by one of the crosspieces 17. These motors are arranged in the inner space I delimited by the wheels 14. Each motor is of the "fast" type, i.e., it works at a high rotational speed (number of revolutions per minute), and consequently has a reduced bulk.

Traditionally, each motor 20 is connected to at least one of the pairs 12 of wheels 14 by means of a coupling shaft 22 and a reducer 24. The coupling shaft 22 of the motor 20 crosses through a beam 16 through an opening 21.

Thus, the coupling shaft 22 extends from the inside of the inner space I toward the outside of this inner space I. For example, the coupling shaft 22 includes toothed coupling means.

Advantageously, the reducer 24 is connected to the support 18 of the chassis 15 using a reacting connecting rod 25, stabilizing this reducer 24 vertically at the coupling shaft of the motor 22.

The bogie 10 also includes secondary suspension means 50, supported by the support 18 of the chassis 15, at least partially outside the inner space I. More particularly, the secondary suspension means 50 are arranged outside an inner zone delimited in the transverse direction Y between the beams 16.

Figure 5:
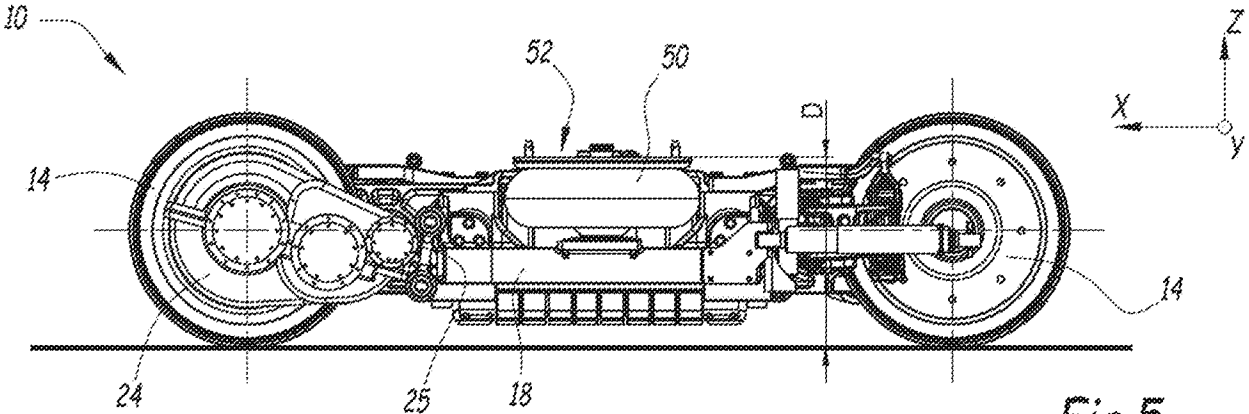
FIG. 5 is a side view of the bogie of FIG. 2.

Advantageously, the highest point of the secondary suspension means 50 is situated below the apex of the wheels 14 in the vertical direction Z, as shown in FIG. 5. The height of this highest point of the secondary suspension means 50, considered from a bearing plane of the wheels 14, is for example substantially equal to 700 mm.

The secondary suspension means 50 are equipped with bearing means 52 at the body 60 of the railway vehicle, making it possible to receive all of the vertical forces exerted by the body 60 on the bogie 10.

As can be seen by comparing FIG. 4, which is a traditional bogie 10' of the state of the art, with FIG. 5, which shows a bogie 10 according to the invention, the structure of the bogie 10 according to the invention allows the arrangement of the secondary suspension means 50 at a height lower than that of the state of the art.

Due to this reduced height, it is possible to arrange an access door 62 of the body at the bogie 10.

Figure 7:
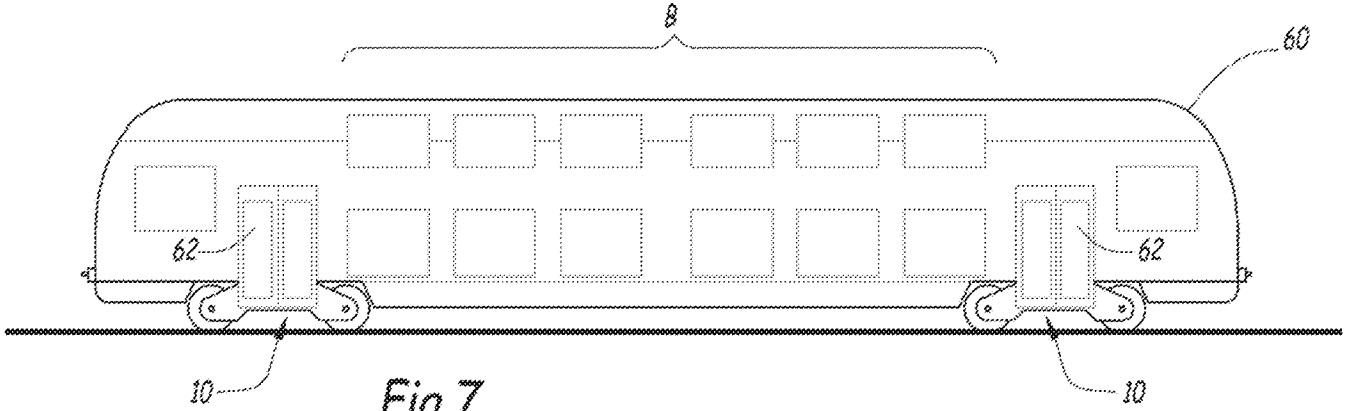
FIG. 7 a diagrammatic side view of a railway vehicle whereof the body is equipped with bogies similar to those of FIG. 2.

The body 60 of the railway vehicle thus includes at least one access door 62 arranged at the bogie 10 (as shown in FIG. 7). The maximum height of a floor at the foot of the door is 850 mm, measured from the bearing plane of the wheels 14 (therefore from the rails). Thus, the height of the door 62 is compatible with the height of a traditional platform, which guarantees passengers the ability to enter and exit the railway vehicle easily.

Figure 6:
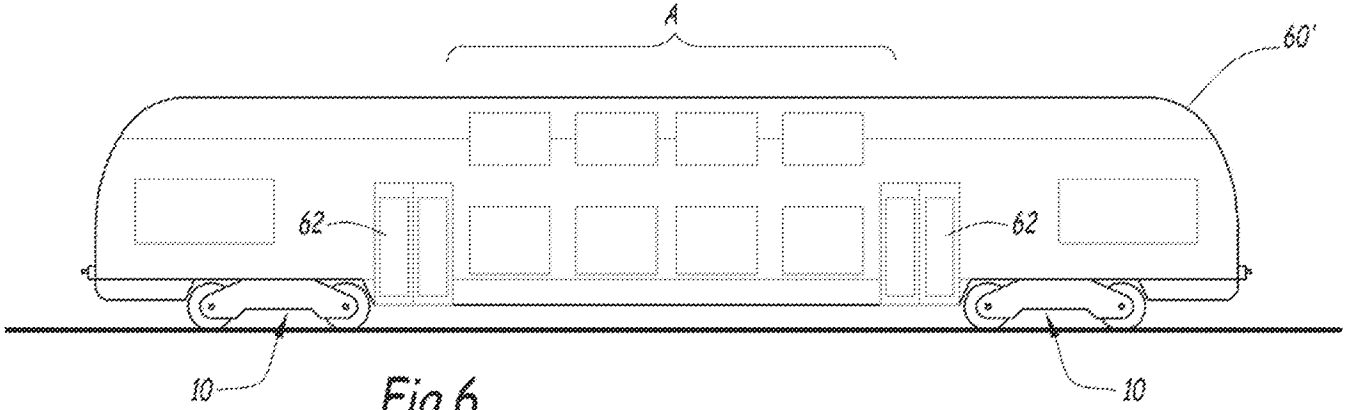
FIG. 6 is a diagrammatic side view of a railway vehicle of the state of the art.

As can be seen by comparing FIG. 6, showing a railway vehicle of the state of the art, and FIG. 7, showing a railway vehicle according to the invention, the longitudinal movement of the doors 62 at the bogies 10 (FIG. 7) makes it possible to arrange a central part B with two floors over a greater length than the central part A of the traditional vehicle (FIG. 6). The railway vehicle of the invention therefore includes two longer levels, and therefore has a greater passenger transport capacity.

It will be noted that the invention is not limited to the embodiment previously described, but could have various alternatives without going beyond the scope of the claims.

In particular, the invention could be applied to a carrier bogie, not including a motor.

Furthermore, the articulations 36 between the beams 16 and the journal boxes 32 could have a structure other than that previously described.

Lastly, the bogie 10 according to the invention could equip any railway vehicle other than a regional express transport train, for example a tram, subway or long-distance train.

What is claimed is:

1. A motorized bogie for a railway vehicle, comprising:

a chassis, including:

two beams extending parallel to one another, and parallel to the longitudinal direction, two crosspieces, supported by the beams, extending parallel to one another, and parallel to a transverse direction perpendicular to the longitudinal direction, two supports, each support being supported by the two crosspieces, two axle structures, each comprising two journal boxes each connected to a respective one of the beams, and a transverse axle shaft, extending in the transverse direction between two ends each supporting a respective wheel, the wheels defining an inner space between them, delimited in the transverse direction between the wheels of a same axle shaft, and delimited in the longitudinal direction between the two axle shafts, at least one motor supported by one of the crosspieces of the chassis, arranged in the inner space delimited by the wheels, and including a coupling shaft, at least one reducer ensuring the mechanical connection between the coupling shaft of the motor and one of the transverse axle shafts, wherein, the motorized bogie includes a primary suspension, including flexible mountings arranged between the crosspieces and the beams of the chassis, the reducer is arranged outside said inner space, the coupling shaft of the motor extending from the motor beyond one of the corresponding beams to the reducer.

2. The motorized bogie according to claim 1, wherein:

each axle structure is connected with a respective one of the beams by an articulation with an axis parallel to the transverse direction, and the primary suspension includes, for each axle structure, at least one damper arranged between the axle structure and the beam.

3. The motorized bogie according to claim 1, including secondary suspensions, supported by each support of the chassis, and including bearings at the railway vehicle body, the secondary suspensions being arranged transversely at least partially outside the inner space.

4. The motorized bogie according to claim 1, wherein each flexible mounting is ring-shaped and is made from an elastic material, this flexible mounting being inserted radially between one of the crosspieces of the chassis and the edges of an orifice arranged in one of the beams.

5. The motorized bogie according to claim 4, wherein each flexible mounting is made from rubber.

6. The motorized bogie according to claim 4, wherein each flexible mounting has an annular shape defined between an inner diameter and an outer diameter, the difference between this inner diameter and this outer diameter being substantially equal to 100 mm.

7. The motorized bogie according to claim 1, wherein each damper is formed by a connecting rod.

8. A railway vehicle, including a body, wherein it includes a motorized bogie for a railway vehicle, comprising:

a chassis, including:

two beams extending parallel to one another, and parallel to the longitudinal direction, two crosspieces, supported by the beams, extending parallel to one another, and parallel to a transverse direction perpendicular to the longitudinal direction, two supports, each support being supported by the two crosspieces, two axle structures, each comprising two journal boxes each connected to a respective one of the beams, and a transverse axle shaft, extending in the transverse direction between two ends each supporting a respective wheel, the wheels defining an inner space between them, delimited in the transverse direction between the wheels of a same axle shaft, and delimited in the longitudinal direction between the two axle shafts, at least one motor supported by one of the crosspieces of the chassis, arranged in the inner space delimited by the wheels, and including a coupling shaft, at least one reducer ensuring the mechanical connection between the coupling shaft of the motor and one of the transverse axle shafts, wherein, the motorized bogie includes primary suspensions, including flexible mountings arranged between the crosspieces and the beams of the chassis, the reducer is arranged outside said inner space, the coupling shaft of the motor extending from the motor beyond one of the corresponding beams to the reducer.

9. The motorized bogie according to claim 8, wherein the body includes at least one access door arranged in register with the motorized bogie.

10. The motorized bogie according to claim 8, wherein the distance, in a vertical direction perpendicular to the longitudinal and transverse directions, between the access door and the bearing plane of the wheels, is less than or equal to 850 mm.

* * * * *